United States Patent [19]

Bouza

[11] Patent Number: 4,979,458

[45] Date of Patent: Dec. 25, 1990

[54] OFFSET STANCHION FOR A FISHING BOAT SEAT

[76] Inventor: William Bouza, 640 Wingate Dr., East Meadow, N.Y. 11554

[21] Appl. No.: 468,179

[22] Filed: Jan. 22, 1990

[51] Int. Cl.[5] ..... B63B 29/00

[52] U.S. Cl. ..... 114/363; 297/344

[58] Field of Search ..... 114/188, 255, 343, 363; 297/340, 344, 346, 188, 345, 240; 248/514, 159, 415, 418, 186.1, 349, 425, 188.2

[56] References Cited

U.S. PATENT DOCUMENTS

| | | | |
|---|---|---|---|
| 2,643,628 | 6/1953 | Sveinsson | 114/34.1 |
| 2,740,599 | 4/1956 | Roberts-Horsfield | 244/122 R |
| 2,787,315 | 4/1957 | Siebert | 114/363 |
| 3,839,757 | 10/1974 | Grimes | 114/363 |
| 4,008,500 | 2/1977 | Hall | 114/363 |
| 4,234,989 | 11/1980 | Pearcy | 114/363 |
| 4,279,398 | 7/1981 | Pergnall | 114/363 |
| 4,425,863 | 1/1984 | Cutler | 114/363 |
| 4,539,926 | 9/1985 | Boffer | 114/363 |
| 4,566,734 | 1/1986 | Bruner | 297/346 |
| 4,567,845 | 2/1986 | Smith | 114/363 |
| 4,597,356 | 7/1986 | McCaghren | 114/363 |
| 4,620,686 | 11/1986 | Conant | 248/415 |
| 4,645,462 | 2/1987 | Fulton | 440/6 |
| 4,709,649 | 12/1987 | Waan | 114/363 |
| 4,722,706 | 2/1988 | Young | 114/363 |
| 4,766,838 | 8/1988 | Johnson | 114/363 |
| 4,798,361 | 1/1989 | Fawcett | 248/415 |
| 4,879,963 | 11/1989 | Dionne | 114/363 |

*Primary Examiner*—Joseph F. Peters, Jr.
*Assistant Examiner*—Clifford T. Bartz
*Attorney, Agent, or Firm*—Stanley J. Yavner

[57] ABSTRACT

An offset stanchion for a fishing boat seat has upright support portion extending through the deck floor of the boat. An offset support portion is rigidly connected to the upper end of the upright support portion above the deck floor, the lower end of the upright support portion being supported and rotatably mounted in a bearing mounted on the hull or rail for securing the keel of the boat. In an alternate embodiment, the upright support portion is supported by a bearing mounted in a can recessed below the deck floor. A seat support portion is rigidly connected to the upper end of the upright support portion and is parallel thereto, so that a seat mounted thereon can be moved to any position about a central axis of the upright support portion on a circle having a radius equal to the spacing between the central and the seat axes.

20 Claims, 2 Drawing Sheets

OFFSET STANCHION FOR A FISHING BOAT SEAT

BACKGROUND OF THE INVENTION

1. Field Of The Invention

The present invention relates to seat supports or pedestals for fishing boats, and in particular to an offset stanchion which permits free movement of the seat to any position along a circle about a central axis.

2. Background Of The Invention

Sport fishing boats normally have a cockpit which is so big that the fishing line touches the side of the boat. Numerous proposals have been made to facilitate the fisherman's ability to move about the deck to avoid such contact. For example, in U.S. Pat. No. 4,709,649, a boat adjustable seat apparatus is disclosed which is provided with an offset from a pedestal fastened to the fishing boat deck. The seat is mounted on a frame which is provided at the bottom thereof with a wheel. The frame and, therefore, the seat is movable in a horizontal plane by rolling the frame on the wheel. However, the seat apparatus disclosed in this patent requires that the frame roll along the deck floor. Such contact with the deck floor limits the possible positions of the seat since the deck floor may itself be small or there may be obstacles on the deck floor which are in path of movement of the frame supporting the seat.

In U.S. Pat. No. 4,620,686, a sport fishing chair is disclosed which includes an articulated seat pedestal having arms which are pivotally connected to each other and which may be gear-driven to achieve variable radius movements of the seat. By varying the arm lengths and gear ratios, the pedestal may be selected to conform to the dimensions of the fishing boat. However, the sport fishing chair of this patent is complicated in construction and expensive to manufacture. Furthermore, because of the gear linkages and chain drive that are used, the lower arm rotates simultaneously, but in opposite directions to the upper arm, rendering the chair complicated and inconvenient to use for rapid changes in position of the chair. In U.S. Pat. No. 3,839,757, a fishing boat seat is disclosed wherein the seat is mounted on linkages for movement between a first lower running position and a second elevated fishing position. However, it is not possible with this seat to move to different positions on the deck while in an elevated or raised fishing position Similarly, an adjustable boat seat pedestal is disclosed in U.S. Pat. No. 4,566,734 wherein a pedestal for mounting a boat seat selectively positions the seat in a centrally located, elevated position or an offset, lowered position, since it is preferable, when fishing from an open boat, for the fisherman to be seated on the centerline of the boat for stability, and at an elevated position for optimum visibility and maneuverability of the fishing gear.

In U.S. Pat. No. 2,740,599, a stabilized seat is disclosed for aircraft wherein the axis of the seat is substantially coincident with the axis of the pivot on which the seat is mounted. The seat is mounted on a post which extends below the floor of the aircraft crew compartment, and a reversible motor and a telescoping jack screw is provided for lowering and raising the pilot seat for adjusting the height of the pilot during landing or taxiing to give a better view of the ground.

A multi-swivel chair is disclosed in U.S. Pat. No. 4,798,361 which includes a support base, the center of the base having a vertical axle supporting a first support arm. The first support arm includes a pivot supporting a second support arm which includes a support fixture for a chair body. The entire structure is mounted on a rectangular base. While the chair is capable of rotating 360 degrees horizontally about the central axis of the chair, a circular floor pad is used upon which the chair structure is mounted, and there is no teaching or suggestion that the chair can be fixedly mounted to a deck floor of a boat. Additionally, the rather large floor pad provided for stability may be difficult to use on a small fishing craft because of the very small deck space available on such fishing crafts. The articulated levers or arms to provide the required eccentricities renders the chair unnecessarily complex in construction and costly to make. In U.S. Pat. Nos. 2,787,315; 4,234,989; 4,425,863 and 4,567,845, different convertible seats are disclosed which do not provide any lateral movements of the seats from their primary axes or mounting pedestals. In the aforementioned Pat. No. 4,567,845, a sleeve is disclosed which is mounted below the deck floor of the boat, which sleeve is adapted to receive a pedestal of the chair, which is removably mounted.

SUMMARY OF THE INVENTION

Accordingly, it is an object of the present invention to provide an offset stanchion for a fishing boat which does not possess the disadvantages inherent in the prior art fishing boat seat support constructions.

It is another object of the present invention to provide an offset stanchion for fishing boat seats which is simple in construction and economical to manufacture.

It is still another object of the present invention to provide an offset stanchion of the type under discussion which provides improved stability by securing the lower end of the supporting stanchion below the deck floor of the boat.

It is yet another object of the present invention to provide an offset stanchion as suggested in the previous objects which permits the chair mounted thereon to rotate 360 degrees around the axis of the supporting post of the stanchion on which the seat is mounted.

It is a further object of the present invention to provide an offset stanchion for fishing boat seats which is simple and convenient to use, and which allows the fisherman to move the position of his seat over a wide range of positions in a quick and efficient manner.

In order to achieve the above objectives, as well as others which will become apparent hereafter, an offset stanchion for a fishing boat seat having a support column defining a seat axis and to be mounted on the deck floor of a boat having an opening therein comprises a substantially upright support portion dimensioned to be received through the deck opening so that the upper end extends above the deck floor and the lower end extends below the deck floor. Said upright support portion defines a central axis which is substantially coaxial with the vertical axis of the deck floor opening when said upright support portion is positioned through the deck floor opening. An offset support portion define a predetermined angle with said central axis and has two ends one of which is rigidly attached to the upper end of said upright support portion. A seat support portion is rigidly attached to the other end of said offset support portion and includes means for rotatably mounting the seat support column about a seat axis which is spaced from and substantially parallel to said central axis. Bearing support means is provided for rotatably mounting the lower end of said upright support portion below the deck floor. In this manner, a seat mounted on said seat support portion can be placed in any position about said central axis on a circle having a radius equal to the spacing between said central and seat axes.

BRIEF DESCRIPTION OF THE DRAWINGS

Apparatus embodying features of the invention are illustrated in the accompanying drawings which form a portion of this application, wherein.

DESCRIPTION OF THE PREFERRED EMBODIMENTS

Figure 1:
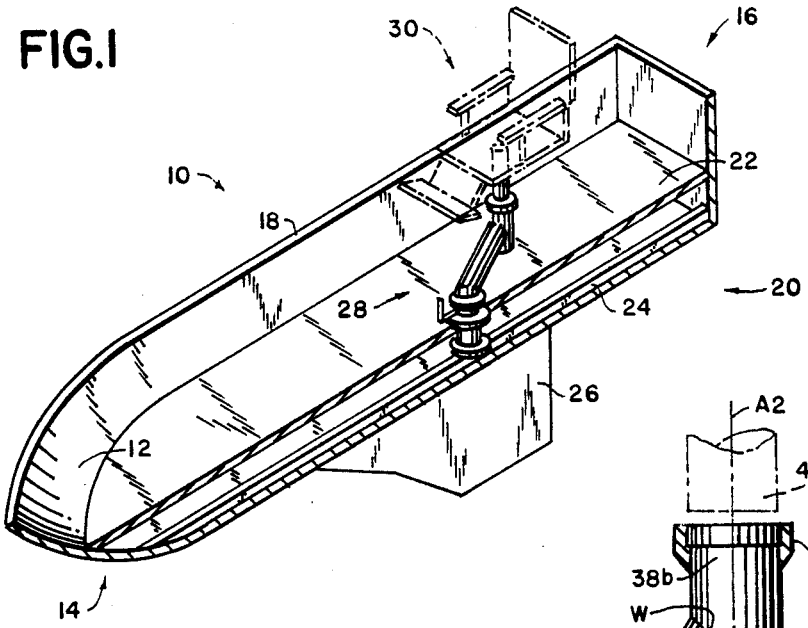
FIG. 1 is a perspective view of a small fishing craft, cut along the longitudinal plane, and illustrating an offset stanchion in accordance with the present invention, and showing a fishing seat in phantom outline mounted on the stanchion.

Turning now to the figures, in which the identical or similar part designated by the same reference numerals throughout, and first referring to FIG. 1, a pleasure or fishing boat is shown and generally designated by the reference numeral 10, the cockpit not being shown for the sake of clarity.

The boat 10 has a hull 12, shown cut longitudinally through the center of the boat along a plane extending from the bow 14 to the stern 16. The starboard side 18, therefore, is visible, with the port side 20 being removed. The boat 10 has a deck floor 22, the hull portion underneath the deck floor generally including a rail 24 or other reinforcement for securing the keel 26 of the boat. The offset stanchion in accordance with the present invention is generally designated by the reference numeral 28, a seat 30 being shown in phantom outline mounted on the stanchion.

Figure 2:
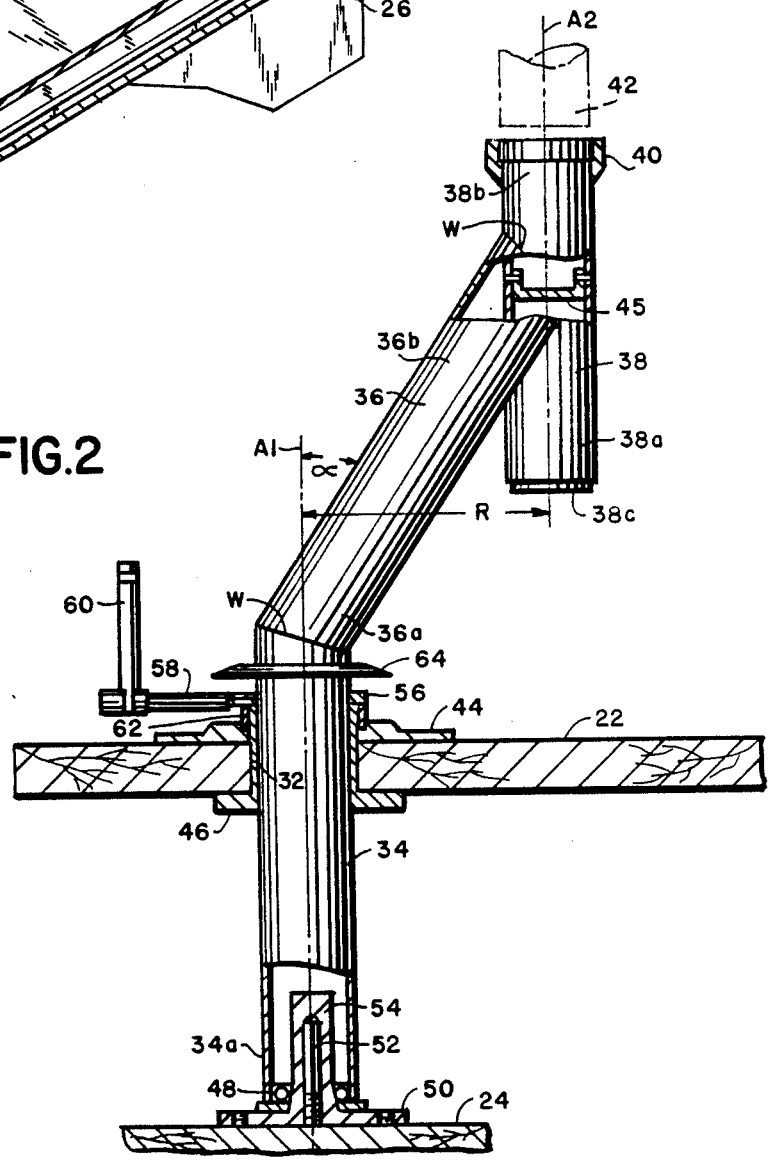
FIG. 2 is an enlarged side elevational view of the stanchion shown in FIG. 1.

Referring to FIG. 2, the deck floor 2 has a mounting opening 32 therein which is dimensioned to receive a substantially upright support portion, post or pedestal 34, a lower end 34*a* being positioned above the deck floor while an upper end 34*b* is positioned above the deck floor. The upright support portion 34 defines a central axis A1 which is substantially coaxial with a vertical axis of the deck floor opening 32 when the upright support portion 34 is positioned through the deck floor opening. An offset support portion 36 defines a predetermined angle $\alpha$ with the central axis A1 and has a lower end 36*a* which is rigidly attached to the upper end 34*b* of the upright support portion 34.

A seat support portion is rigidly attached to the upper end 36*b* of the offset portion and includes means for mounting the seat 30, as will be more fully described below. In the embodiment shown, the seat support portion includes a seat support tube 38 having a lower end 38*b* of closed at the bottom by a cover 38*c*. The upper end 38*b* of the tube 38 is open and reinforced by an annular neck or collar 40. The tube 38 has an inside diameter which is dimensioned to receive the seat support column or shaft 42. The tube 38 rotatably mounts the seat column 42 about a seat axis A2 which is spaced from and substantially parallel to the central axis A1 at a distance R.

Bearing support means, to be more fully described, is provided for rotatably mounting the lower end 34*a* of the upright support portion 34 below the deck floor 22. In this manner, a seat 30 mounted on the seat support tube 38 can be placed in any position about the central axis A1 on a circle having a radius equal to the spacing between the central axis A1 and the seat axis A2. The upright support portion 34 is rigidly secured to the offset support portion 36 by means of weld W. Similarly, the seat support tube 38 is rigidly connected to the offset support portion 36 by means of a weld W. By welding the elements or members 34, 36 and 38 to each other, a rigid construction results which is simple, inexpensive to manufacture and provides safe and reliable support for the seat.

In order to align the axis of the upright support portion 34 with the hole 32 on the floor deck, there is advantageously provided a deck plate 44 which is used to align the central axis A1 of the portion 34 with the vertical axis of the floor opening. The deck plate 44 has an opening to receive the upright support portion 34 with little clearance. Attaching means (not shown), of any conventional type, can be used to secure the deck plate to the deck floor 22.

In one presently preferred embodiment, the boat has a hull or keel rail 24 below the deck floor 22, and the bearing support for the lower end 34*a* of the upright support portion is mounted on the hull or keel rail. This generally maximizes the length of the upright support portion 34 and provides the greatest stability.

While the seat support portion has been illustrated to be a support tube 38, it will become evident to those skilled in the art that any other method for rotatably mounting the seat column 42 at the end 36*b* of the offset portion 36 could be used, with different degrees of advantage. When a support tube 38 is used, there is advantageously provided within the tube a bearing, such as an aluminum bearing 45 which receives the seat support column 42 with little clearance, thereby facilitating rotation of the seat about the support tube 38.

A ring or flange 46 is shown which may be used below the deck floor to lock or secure the upright support portion 34 in place.

A bearing for supporting the lower end 34*a* of the upright support portion 34 is shown, in FIG. 1, to include a bearing 48 which is welded at its periphery to the tube forming the upright support portion 34, and having central opening therein aligned with the axis A1. A mounting flange 50 is secured to the rail 24 by any suitable means (not shown), the mounting flange 50 having a central opening which receives a vertically extending pin or rod 52 which is aligned with the axis A1. The pin or rod is coaxial with the axis A1 and, it is securely attached to the mounting flange 50 by any suitable or conventional means, such as threaded screws, welding or the like. In some instances, the pin or rod may be formed of a plastic material, in which case the part may have to be threaded into the mounting flange 50.

A positioning or centering member is shown in the form of a sleeve 54 which is closed at the upper end and open at the lower end, and having a channel or bore therethrough dimensioned to receive the pin or rod 52 with little clearance. The sleeve 54 is tapered outwardly at the bottom end thereof as shown so as to be captured by the bearing 48 which is preferably also provided with a like taper on the inside diameter thereof to correspond to the external taper at the lower end of the sleeve 54.

Advantageously, there is provided a locking ring 56, which may be in the form of a split ring which can be tightened by means of a threaded locking stud 58 which has mounted thereon a transverse locking handle 60 as shown.

Plastic bearings in the form of bushings or rings 62 are advantageously provided which maintain the upright support portion 34 aligned and facilitates rotation thereof with minimal friction.

An optional, although desirable, protective ring 64 is provided on the upright support portion 34 in close proximity above the locking ring 56 to minimize water spray on the locking ring. Additionally, the protective ring or plate helps to avoid damage or injury which may result from contact with the locking ring 56. The protective ring 64 also serves an aesthetic function to cover the hardware mounted on the deck floor 22.

Figure 3:
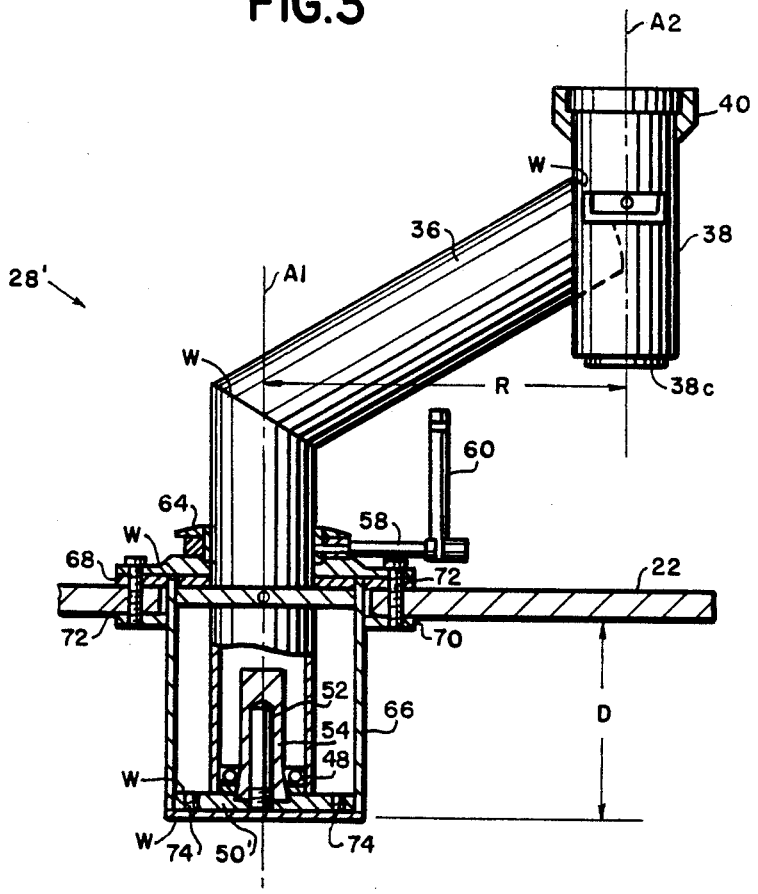
FIG. 3 is a view similar to FIG. 2, but showing another embodiment of the stanchion.

Referring to FIG. 3, an alternate embodiment of the offset stanchion is shown which can be used with boats that contain gas tanks, water tanks, bait wells, or the like below the deck floor, so that it may not be possible to utilize the design shown in FIG. 1. In this embodiment 28', a recessed floor arrangement is mounted on the deck floor for providing a support surface positioned below the deck floor, which serves the function of the rail 24 in FIG. 1. In this embodiment, the lower bearing support is mounted on such support surface.

The stanchion 28' includes a cylindrical can 66 which is rigidly secured, such as by welding, to a flange 68 mounted above the deck and aligned with the axis A1. A lower flange 70 is dimensioned to receive the can 66, below the deck, with a loose fit. The flanges 68,70 are attached to each other, with the deck floor in between, by means of bolts 72 or the like. This rigidly attaches the can 66 to the deck floor, the bottom end of the can 66 being closed by means of a bottom plate 50' which, similarly, is attached about its periphery to the can 66 by means of welds W both inside and outside the can. Preferably, drain holes 74 are provided in the bottom plate 50' to drain any water which is captured within the can.

Although the axial height of the can 66 is not critical, it has been found that a height D of approximately 5" is satisfactory.

Because the stanchions 28,28' may be utilized in salt water, all of the parts thereof should be made either of stainless steel or plastic material. Also, where friction takes place, such as in bearings, it is also desirable to use stainless steel for one of the mating components, and plastic material for the other mating components.

The offset stanchions in accordance with the present invention make it possible for a fisherman to avoid having a fishing line touch the sides of the boat, since the seat can be mounted sufficiently high. Yet, the stanchion is inexpensive to manufacture, and very easy to use. A fisherman can quickly and effectively change his position over a wide surface or area of the deck with minimal effort.

The foregoing are considered as examples of the invention. Further, since numerous modifications and changes will readily occur to those skilled in the art, it is not desired to limit the invention to the exact construction and operation shown and described and, accordingly, all suitable modifications and equivalents may be resorted to, which fall within the scope of the invention.

What is claimed is:

1. An offset stanchion for a fishing boat seat having a support column defining a seat axis, said stanchion to be mounted on a deck floor having a mounting opening therein, comprising a substantially upright support portion dimensioned to be received through the deck opening so that the upper end extends above the deck floor and the lower end extends below the deck floor, said upright support portion defining a central axis which is substantially coaxial with a vertical axis of the deck floor opening when said upright support portion is positioned through the deck floor opening; an offset support portion defining a predetermined angle between said offset support portion and said central axis and having two ends one of which is rigidly attached to the upper end of said upright support portion; a seat support portion rigidly attached to the other end of said offset support portion and including means for rotatably mounting the seat support column about a seat axis which is spaced from and substantially parallel to said central axis; and bearing support means for rotatably mounting the lower end of said upright support portion below the deck floor, whereby a seat mounted on said seat support portion can be placed in any position about said central axis on a circle having a radius equal to the spacing between said central and seat axes.

2. An offset stanchion as defined in claim 1, wherein said upright offset and seat support portions are welded to each other.

3. An offset stanchion as defined in claim 1, further comprising alignment means for aligning said central axis with the vertical axis of the floor opening.

4. An offset stanchion as defined in claim 3, wherein said alignment means comprises at least one deck plate having an opening to receive said upright support portion with little clearance; and attaching means for securing said at least one deck plate to the deck floor to position said opening in said at least one deck plate along the axis of the hole of the deck floor.

5. An offset stanchion as defined in claim 1, wherein the boat has a hull or keel rail below the deck floor, and said bearing support means is mounted on the hull or keep rail.

6. An offset stanchion as defined in claim 1, further comprising recessed floor means mounted on the deck floor for providing a support surface positioned below the deck floor, said bearing support means being mounted on said support surface.

7. An offset stanchion as defined in claim 6, wherein said recessed floor means comprises a cylindrical can attached to the deck floor at an upper open end and having a closed lower end which forms said support surface.

8. An offset stanchion as defined in claim 1, wherein said seat support portion comprises a support tube having a longitudinal axis which is coaxial with said seat axis when the seat support column is mounted on said support tube.

9. An offset stanchion as defined in claim 8, wherein said support tube is hollow and has an internal diameter dimensioned to receive the seat support column with little clearance.

10. An offset stanchion as defined in claim 9, further comprising a bearing within said support tube to facilitate rotation of the seat about said support tube.

11. An offset stanchion as defined in claim 1, wherein said bearing support means includes a pivot pin along the axis of the opening of the deck floor; and a sleeve coupled to the lower end of said upright support portion having an internal diameter dimensioned to slidably receive said pivot pin.

12. An offset stanchion as defined in claim 11, wherein said sleeve is closed at the top end thereof and open at the bottom end thereof, when mounted on said pivot pin.

13. An offset stanchion as defined in claim 11, wherein said pivot pin is made of a plastic material.

14. An offset stanchion as defined in claim 11, wherein said sleeve is made of a plastic material.

15. An offset stanchion as defined in claim 1, further comprising locking means for locking the stanchion relative to the deck floor thereby preventing rotation of the seat.

16. An offset stanchion as defined in claim 15, wherein said locking means comprises a locking ring mounted about said upright support portion and being fixedly mounted in relation to the deck floor, and handle means for selectively tightening said locking ring.

17. An offset stanchion as defined in claim 16, further comprising a protective ring mounted on said upright support portion in close proximity above said locking ring to minimize water spray on said locking ring.

18. An offset stanchion as defined in claim 1, further comprising upper bearing means mounted on said upright support portion above the deck floor to minimize friction and facilitate rotation of the stanchion.

19. An offset stanchion as defined in claim 18, wherein said upper bearing means comprises a plastic bearing.

20. An offset stanchion as defined in claim 7, wherein said closed lower end of said can is provided with drain holes.

* * * * *